US006655787B1

(12) United States Patent
Hawkins

(10) Patent No.: US 6,655,787 B1
(45) Date of Patent: Dec. 2, 2003

(54) DROP-ON-DEMAND LIQUID EMISSION USING SYMMETRICAL ELECTROSTATIC DEVICE

(75) Inventor: Gilbert A. Hawkins, Mendon, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/228,623

(22) Filed: Aug. 26, 2002

(51) Int. Cl.[7] ..... B41J 2/04
(52) U.S. Cl. ..... 347/54
(58) Field of Search ..... 347/54, 55, 151, 347/120, 141, 154, 103, 123, 111, 159, 127, 128, 131, 125, 158; 399/271, 290, 292, 293, 294, 295

(56) References Cited

U.S. PATENT DOCUMENTS

| | | | |
|---|---|---|---|
| 5,644,341 A | | 7/1997 | Fujii et al. |
| 5,668,579 A | | 9/1997 | Fujii et al. |
| 5,739,831 A | | 4/1998 | Nakamura et al. |
| 6,127,198 A | | 10/2000 | Coleman et al. |
| 6,318,841 B1 | | 11/2001 | Coleman et al. |
| 6,322,201 B1 | * | 11/2001 | Beatty et al. |
| 6,345,884 B1 | | 2/2002 | Yoon et al. |
| 6,357,865 B1 | | 3/2002 | Kubby et al. |
| 2001/0023523 A1 | | 9/2001 | Kubby et al. |

* cited by examiner

*Primary Examiner*—Raquel Yvette Gordon
(74) *Attorney, Agent, or Firm*—Milton S. Sales

(57) ABSTRACT

An inkjet print head comprises a mandrel having flat front and rear surfaces disposed between an initially curved rear membrane and an initially flat front membrane. The rear membrane is initially hemispherically curved, in close contact at its periphery with the rear surface of the mandrel but substantially removed from the mandrel in its central region. Because the membranes are mechanically coupled, the initially curved rear membrane causes the initially flat front membrane to bow away from the front surface of the mandrel. Ink contacts only one membrane, preferably the front membrane, which is typically held at a ground potential. By applying a voltage sequence to the membranes and mandrel, the position of the actuator may be controlled in a "push-pull" manner.

15 Claims, 3 Drawing Sheets

DROP-ON-DEMAND LIQUID EMISSION USING SYMMETRICAL ELECTROSTATIC DEVICE

CROSS-REFERENCE TO RELATED APPLICATION

Reference is made to my commonly assigned, co-pending U.S. patent application Ser. No. 10/229,359 entitled FABRICATING LIQUID EMISSION ELECTROSTATIC DEVICE USING SYMMETRICAL MANDREL filed concurrently herewith.

FIELD OF THE INVENTION

The present invention relates generally to drop-on-demand liquid emission devices such as, for example, ink jet printers, and more particularly such devices which employ an electrostatic actuator for driving liquid from the device.

BACKGROUND OF THE INVENTION

Drop-on-demand liquid emission devices with electrostatic actuators are known for ink printing systems. U.S. Pat. No. 5,644,341 and U.S. Pat. No. 5,668,579, which issued to Fujii et al. on Jul. 1, 1997 and Sep. 16, 1997, respectively, disclose such devices having electrostatic actuators composed of a diaphragm and opposed electrode. The diaphragm is distorted by application of a first voltage to the electrode. Relaxation of the diaphragm expels an ink droplet from the device. Other devices that operate on the principle of electrostatic attraction and their fabrication methods are disclosed in U.S. Pat. No. 5,739,831; U.S. Pat. No. 6,127,198; U.S. Pat. No. 6,357,865; U.S. Pat. No. 6,318,841; and U.S. Pub. No. 2001/0023523. Devices of these types typically require a high voltage to operate, because the gap between the diaphragm and its opposed electrode must be sufficiently large to allow for the diaphragm to move far enough to alter the liquid chamber volume by a significant amount. Large gaps, while advantageous in their tolerance to manufacturing tolerances, require large operating voltages to effect drop ejection, and this adds a manufacturing cost associated with high voltage circuitry.

The gap can be designed to be small, in order to reduce the required voltage, but this requires that the area of the device be large, so that the total volume of liquid displaced during drop ejection is kept constant. Furthermore, devices with small gaps also require very precise manufacturing methods. Such devices have been disclosed, for example, in a paper entitled "A Low Power, Small, Electrostatically-Driven Commercial Inkjet Head" by S. Darmisuki et al. of Seiko Epson Corporation; IEEE Conference Proceeding "MEMS 1998," January 25–29, Heidelberg, Germany. That paper describes a method of fabrication of an electrostatic drop liquid emission device having a small gap in which three substrates, two glass and one silicon, are anodically bonded to form an ink ejector. Drops from an ink cavity are expelled through an orifice in the rear side glass plate when a membrane formed in the silicon substrate is pulled down across the gap to contact a conductor on the front side glass plate, and is then released. Because the gap is small, the device occupies a large area; and because of the complex manufacturing method, each nozzle is expensive to manufacture.

Another related method of fabrication provides devices that use ink as a dielectric material. This reduces the operating voltage without the need for making the gaps small because the effective electrical gap is lowered by the high dielectric constant of the ink. For example, U.S. Pat. No. 6,345,884 teaches a device having an electrostatically deformable membrane with an ink refill hole in the membrane and with an electric field applied across the ink to deflect the membrane. The operating voltage is lower for this device. However, for this device, as well as others relying on ink enhanced dielectric constants, the electric field must be applied across the ink, and this reduces reliability. Also, the ink types are restricted in their ranges of dielectric constant and conductivity.

In addition to requiring high voltages, large areas, and/or complex manufacturing techniques, prior art electrostatic drop ejectors are sensitive to the elastic properties of the membranes from which they are made. In particular, it is important that displaced membranes return to their initial positions. Membrane properties are not always sufficient for that purpose, particularly for those membranes suitable for inexpensive manufacture. In particular, membranes may stick in an unreliable manner when in contact with other surfaces, and the elastic properties of membranes, such as tension and stiffness, are not always identical from membrane to membrane due to non-uniformities in deposition. Commonly assigned, copending U.S. patent application Ser. No. 10/152,194 provides for reduction of operating voltages without adding to device size, and additionally for reducing the dependence of membrane motion on elastic properties. These devices are made by a process that allows independent control of voltages on multiple electrodes, and hence allows the use of an electric field to return membranes to their initial positions. The method of manufacture of devices in accordance with application Ser. No. 10/152,194 provides a non-planar central electrode, also referred to as a mandrel. While effective in its intended purpose, a non-planar central electrode requires additional fabrication steps at an early stage of manufacture. Also, since the membranes are stretched upon initial actuation in accordance with application Ser. No. 10/152,194 and since the amount of stretch depends sensitively on the initial membrane tensile stress, the required actuation voltage is sensitive to the manufacturing process.

Prior art electrostatic drop ejectors, even those operating with reduced voltages and even those made to minimize manufacturing tolerances, require complex electrical interconnects at packaging. Interconnects typically require dielectric passivation on the print head's front side (nozzle side). Because the voltages needed for electrostatic devices are in all cases higher than one to two volts, front side interconnects are subject to corrosion from spilled ink. The fabrication of ink channels, typically provided from the back side for such devices, adds to manufacturing cost, and the fabricated ink channels are typically susceptible to clogging.

There is therefore a need to decreasing the operating voltage of electrostatic drop ejectors without compromising reliability or manufacturing cost, and a need to reduce packaging complexity, including the electrical interconnects.

SUMMARY OF THE INVENTION

An emission device for ejecting a liquid drop includes a liquid chamber and a nozzle orifice. Force applied to a first membrane in a first direction increases the chamber volume to draw liquid into the chamber. Force applied to a second membrane in a second direction decreases the chamber volume to emit a liquid drop through the nozzle orifice. A mandrel is between the first and second membranes such that (1) application of a voltage differential between the first membrane and the mandrel moves the first membrane in the first direction to increase the chamber volume and (2) application of a voltage differential between the second membrane and the mandrel moves the second membrane in the second direction to decrease the chamber volume. The mandrel has substantially planar opposed surfaces respectively facing each of the first and second membranes such that least one of the first and second membranes is substantially removed from the mandrel over a first portion of the at least one membrane and is substantially contacting the mandrel over a second portion of the at least one membrane, whereby movement of the first membrane in the first direction progressively increases contact between the first membrane and the mandrel, and movement of the second membrane in the second direction progressively increases contact between the second membrane and the mandrel.

DETAILED DESCRIPTION OF THE INVENTION

As described in detail herein below, the present invention provides an apparatus and method of operating a drop-on-demand liquid emission device based on electrostatic actuators so as to improve energy efficiency and overall drop emission productivity. Drop-on-demand liquid emission devices are often used as print heads in ink jet printing systems. Many other applications are emerging which make use of devices similar to ink jet print heads, which emit liquids other than inks that need to be finely metered and deposited with high spatial precision.

Figure 1:
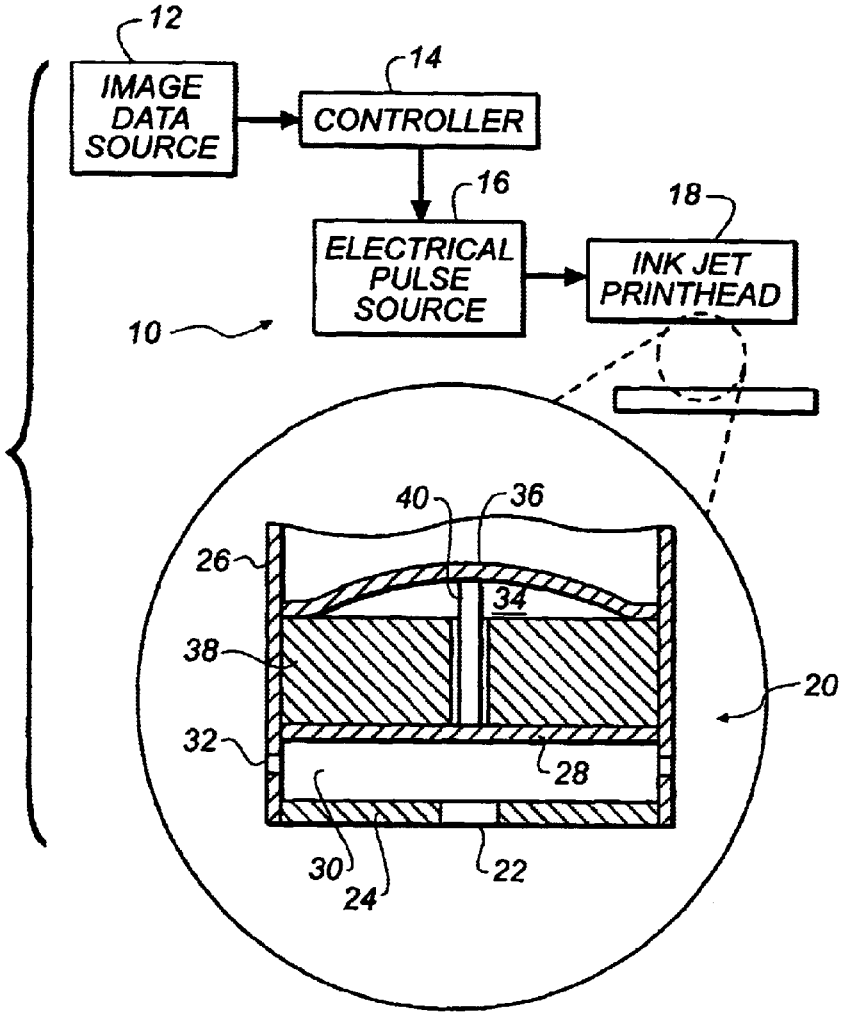
FIG. 1 is a schematic illustration of a drop-on-demand liquid emission device according to the present invention.

FIG. 1 shows a schematic representation of a drop-on-demand liquid emission device 10, such as an ink jet printer, which may be operated according to the present invention. The system includes a source 12 of data (say, image data) which provides signals that are interpreted by a controller 14 as being commands to emit drops. Controller 14 outputs signals to a source 16 of electrical energy pulses which are inputted to a drop-on-demand liquid emission device such as an ink jet printer 18.

Figure 2:
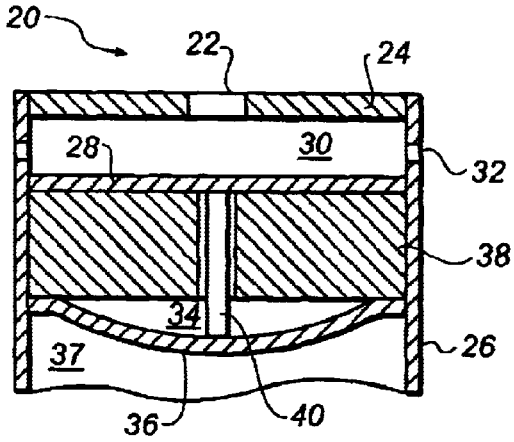
FIG. 2 is a cross-sectional view of a portion of drop-on-demand liquid emission device of FIG. 1.

Drop-on-demand liquid emission device 10 includes a plurality of electrostatic drop ejection mechanisms 20, and FIG. 2 is a cross-sectional view of one of the plurality of electrostatically actuated drop ejection mechanisms 20. A nozzle orifice 22 is formed in a nozzle plate 24 for each mechanism 20. A wall or walls 26 bound each drop ejection mechanism 20.

The outer periphery of an electrically addressable electrode membrane 28 (herein referred to as the "front side" membrane) is sealingly attached to wall 26 to define a chamber 30 adapted to receive the liquid, such as for example ink, to be ejected from nozzle orifice 22. The liquid is drawn into chamber 30 through one or more refill ports 32 from a supply, not shown, typically forming a meniscus in the nozzle orifice. Ports 32 are sized as discussed below. Dielectric fluid fills a region 34 between front side membrane 28 and a rear side membrane 36. The dielectric fluid is preferably air or other dielectric gas, although a dielectric liquid may be used.

Rear side membrane 36, between chamber 30 and a cavity 37, is electrically addressable separately from front side membrane 28. Addressable membranes 28 and 36 are at least partially flexible and are positioned on opposite sides of a single central electrode-mandrel 38 such that the two membranes and the mandrel are generally axially aligned with nozzle orifice 22.

Typically, front and rear side membranes 28 and 36 are made of somewhat flexible conductive material such as polysilicon, or, in the preferred embodiment, a combination of layers having a central conductive layer surrounded by an rear side and front side insulative layer. For example a preferred combination comprises a thin film of polysilicon stacked over a nitride layer to make the membrane structurally stiff. Mandrel 38 is preferably made from a conductive central body surrounded by a thin insulator of uniform thickness, for example silicon oxide or silicon nitride, and is rigidly attached to walls 26. The axially-spaced surfaces of mandrel 38 are flat. The mandrel associated with each nozzle is independently electrically addressable.

Rear side membrane 36 is formed with its outer periphery in substantially close proximity to, or in mechanical contact with, the rear side surface of mandrel 38, and with its central region substantially spaced from the rear side surface of the mandrel so that the volume of the space is at least equal to the volume of a drop to be emitted. Front side membrane 28 is formed in substantially close proximity to, or in mechanical contact with, the front side surface of mandrel 38, at least around its outer periphery. Around the edge of the membranes, the angle of contact between the membranes and mandrel is very small, preferably less than 5 degrees. This is achieved in the case of the front side 28 by forming the front side membrane in uniform proximity to the front side surface of the mandrel. It is therefore planar. This is achieved in the case of rear side membrane 36 by making it convex away from the mandrel.

The two addressable membranes are structurally connected via a rigid coupler 40. This coupler is electrically insulating, which term is intended to include a coupler of conductive material but having a non-conductive break therein. Coupler 40 ties the two addressable membranes structurally together and insolates the membranes so as to make possible distinct voltages on the two. The coupler may be made from conformally deposited silicon dioxide. Due to the coupling of the membranes, and because each membrane is deposited in a state of tension, the released coupled membranes move to an equilibrium position in which each membrane is in substantially close proximity to, or in mechanical contact with, the mandrel around the outer periphery and substantially spaced from the mandrel in the central region of the actuator.

The drop-on-demand liquid emission device according to the disclosed embodiment of the present invention provides for electrical connections removed from the fluid connections. The electrical connections are preferably disposed on the side of the print head opposite the nozzle.

Figure 3:
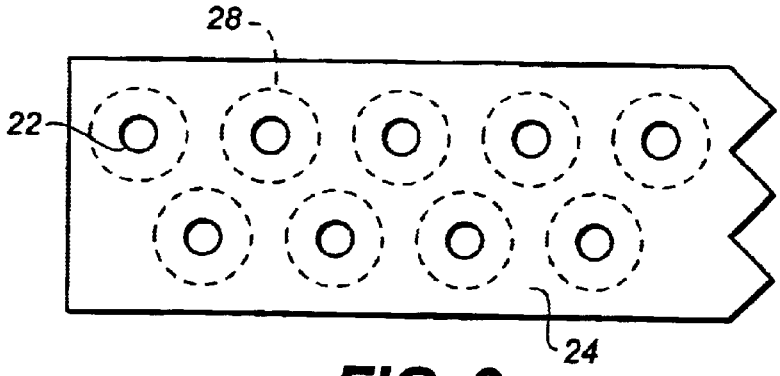
FIGS. 3–5 are top plan views of alternative embodiments of a nozzle plate of the drop-on-demand liquid emission device of FIGS. 1 and 2.
Figure 4:
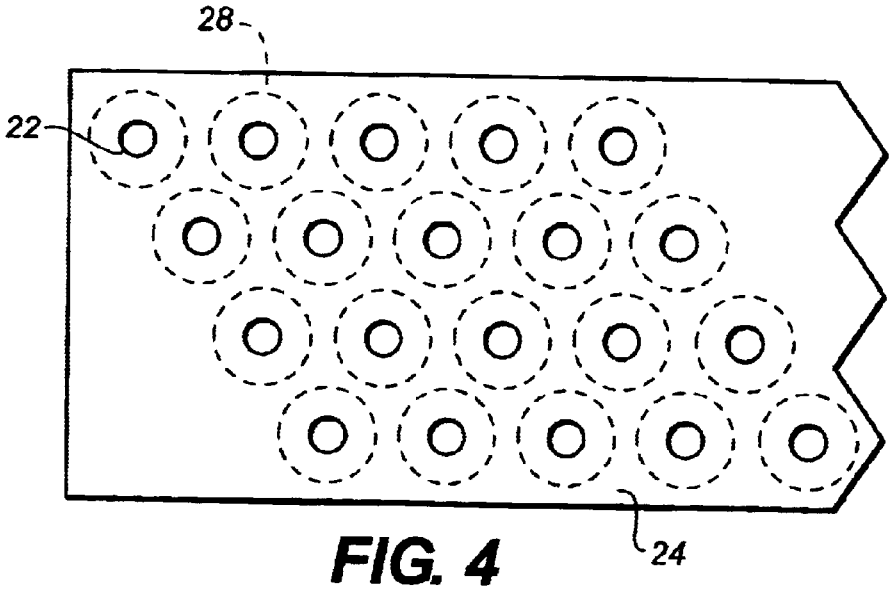
Figure 5:
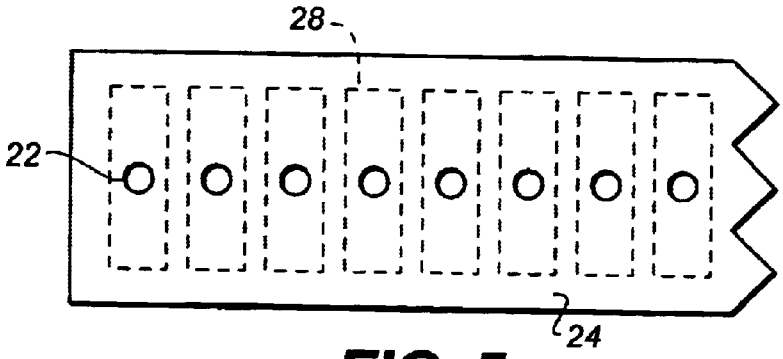

FIGS. 3–5 are top plan views of nozzle plate 24, showing several alternative embodiments of layout patterns for the several nozzle orifices 22 of a print head. Note that in FIGS. 2 and 3, the interior surface of walls 26 are annular, while in FIG. 5, walls 26 form rectangular chambers. Other shapes are of course possible, and these drawings are merely intended to convey the understanding that alternatives are possible within the spirit and scope of the present invention.

To eject a drop, starting from the equilibrium configuration in which each membrane is substantially spaced from the mandrel in the central region of the actuator, an electrostatic potential is applied between conductive portions of, or associated with, front side membrane 28 and mandrel 38. The potentials of central mandrel 38 and rear side membrane 36 are kept at the same. Front side membrane 28 presses down on rear side membrane 36 through rigid coupler 40, thereby deforming rear side membrane 36 downward, as shown, and storing elastic potential energy in the system. Since front side membrane 28 forms a wall portion of liquid chamber 30 behind the nozzle orifice, movement of front side membrane 28 away from nozzle plate 24 expands the chamber, drawing liquid into the expanding chamber through ports 32. Rear side membrane 36 does not receive an electrostatic charge, that is, its voltage is the same as central mandrel 38, and moves in conjunction with front side membrane 28. In accordance with a feature of the present invention, the angle of contact between the front side surface of addressable membrane 28 and the rear side surface of central mandrel 38 is less than 10 degrees and preferably less than 5 degrees. This ensures the voltage difference required to pull addressable membrane 28 down into contact with central mandrel 38 is small.

Figure 6:
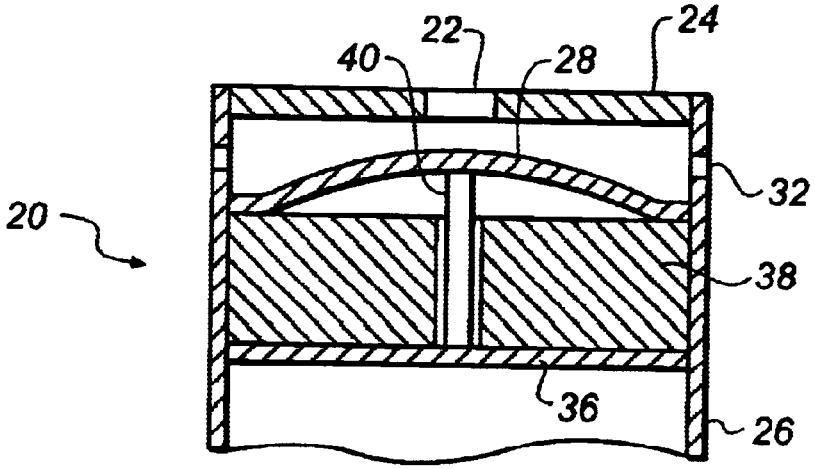
FIG. 6 is a cross-sectional view of the drop-on-demand liquid emission device of FIG. 2 shown in a second actuation stage.

Subsequently (say, several microseconds later) front side membrane 28 is de-energized by making its potential equal to that of mandrel 38. At that time, rear side membrane 36 is energized by applying a potential difference between the conductive portions of rear side membrane 36 and the mandrel. The result is that rear side membrane 36 is caused to be pulled toward central mandrel 38 in conjunction with the release of the stored elastic potential energy. The timing of the de-energization of membrane 28 and the energization of membrane 36 may be simultaneous, or there may be a short dwell period therebetween so that the structure begins to move from the position illustrated in FIG. 2 toward the position illustrated in FIG. 6 under the sole force of stored elastic potential energy in the system. When coupled membranes 28 and 36 move toward nozzle orifice 22, the contact area between rear side membrane 36 and mandrel 38 progressively increases and the surface area of the rear side membrane progressively decreases because its curvature decreases. Simultaneously, the contact area between front side membrane 28 and the mandrel progressively decreases and the surface area of the front side membrane progressively increases. Still referring to FIG. 2, this action pressurizes the liquid in chamber 30 behind the nozzle orifice, causing a drop to be ejected from the nozzle orifice. To optimize both refill and drop ejection, ports 32 should be properly sized to present sufficiently low flow resistance so that filling of chamber 30 is not significantly impeded when membrane 28 is energized, and yet present sufficiently high resistance to the back flow of liquid through the port during drop ejection, as is well known in the design of inkjet print heads.

What is claimed is:

1. An emission device for ejecting a liquid drop, said device comprising:

a chamber of variable volume adapted to receive a liquid and having a nozzle orifice through which a drop of received liquid can be emitted;

a first membrane associated with the chamber such that movement of the first membrane in a first direction increases the chamber volume to draw liquid into the chamber;

a second membrane associated with the chamber such that movement of the second membrane in a second direction decreases the chamber volume to emit a liquid drop through the nozzle orifice; and a mandrel between the first and second membranes such that (1) application of a voltage differential between the first membrane and the mandrel moves the first membrane in said first direction to increase the chamber volume and (2) application of a voltage differential between the second membrane and the mandrel moves the second membrane in said second direction to decrease the chamber volume, said mandrel having substantially planar opposed surfaces respectively facing each of said first and second membranes at an angle of contact such that least one of said first and second membranes is substantially removed from the mandrel over a first portion of the at least one membrane and is substantially contacting the mandrel over a second portion of the at least one membrane, whereby:

movement of the first membrane in the first direction progressively increases contact between the first membrane and the mandrel, and movement of the second membrane in the second direction progressively increases contact between the second membrane and the mandrel.

2. An emission device for ejecting a liquid drop as defined in claim 1, wherein the first portion of the at least one membrane that is substantially removed from the mandrel is central to the least one membrane.

3. An emission device for ejecting a liquid drop as defined in claim 1, wherein the angles of contact between opposed surfaces of the mandrel and the respectively-faced first and second membranes are less than 10 degrees.

4. An emission device for ejecting a liquid drop as defined in claim 1, wherein the angles of contact between opposed surfaces of the mandrel and the respectively-faced first and second membranes are less than 5 degrees.

5. An emission device for ejecting a liquid drop as defined in claim 1, wherein the emission device is a print head of an ink jet printing system.

6. An emission device for ejecting a liquid drop as defined in claim 1, further comprising a controller having:

a first state applying an electrostatic charge differential between the first membrane and the mandrel; and a second state applying an electrostatic charge differential between the second membrane and the mandrel.

7. A liquid drop emission device as set forth in claim 6 wherein the controller is adapted to provide a short dwell period between said first and second states.

8. An emission device for ejecting a liquid drop as defined in claim 1, wherein the mandrel is a ground electrode.

9. An emission device for ejecting a liquid drop as defined in claim 8, wherein the mandrel is structurally stiff.

10. An emission device for ejecting a liquid drop as defined in claim 1, wherein the addressable membranes are structurally connected by a rigid coupler.

11. An emission device for ejecting a liquid drop as defined in claim 10, wherein the coupler is electrically insulating.

12. An emission device for ejecting a liquid drop as defined in claim 10, wherein the coupler is formed of a conductive material having a non-conductive break therein.

13. An emission device for ejecting a liquid drop, said device comprising:

structure defining a chamber volume adapted to receive a liquid and having a nozzle orifice through which a drop of received liquid can be emitted;

structurally coupled, separately electrically addressable first and second dual membranes movable in a first direction to draw liquid into the chamber and in a second direction to emit a liquid drop from the chamber through the nozzle orifice; and a mandrel between the dual membranes, said mandrel having:

substantially planar opposed surfaces respectively facing each of said first and second membranes, and a first portion of at least one membrane being removed from the mandrel and a second portion of the at least one membrane contacting the mandrel, such as to form an angle of contact between the mandrel and the at least one membrane whereby movement of the dual membranes in the first direction progressively increases contact between the first membrane and the mandrel, and movement of the dual membranes in the second direction progressively increases contact between the second membrane and the mandrel.

14. A drop ejection device having mechanically front and rear coupled membranes disposed about a planar mandrel, at least one membrane being:

substantially removed from the mandrel over a first portion of the at least one membrane; and substantially contacting the mandrel in another portion.

15. An inkjet print head comprising:

an initially hemispherically curved rear membrane and an initially flat front membrane; and a mandrel having flat front and rear surfaces disposed between the rear and front membranes, the rear membrane being in close contact at its periphery with the rear surface of the mandrel but substantially removed from the mandrel in its central region, whereby the initially curved rear membrane causes the initially flat front membrane to bow away from the front surface of the mandrel.

* * * * *